US005778755A

United States Patent [19]

Boese

[11] Patent Number: 5,778,755

[45] Date of Patent: Jul. 14, 1998

[54] CONTROL VALVE HAVING A SENSOR SWITCHABLE BETWEEN AN OPEN AND A CLOSED CONDITION

[75] Inventor: Thomas Gene Boese, Rockford, Ill.

[73] Assignee: Greenlee Textron Inc., Rockford, Ill.

[21] Appl. No.: 609,724

[22] Filed: Mar. 1, 1996

[51] Int. Cl.[6] ..... F15B 15/22

[52] U.S. Cl. ..... 91/399; 91/401; 91/437

[58] Field of Search ..... 91/399, 401, 437; 60/468

[56] References Cited

U.S. PATENT DOCUMENTS

| | | | |
|---|---|---|---|
| 2,389,654 | 11/1945 | Van Der Werff | 91/401 |
| 3,694,839 | 10/1972 | Loblick | 91/401 |
| 3,882,883 | 5/1975 | Droegemueller . | |
| 4,256,433 | 3/1981 | King | 91/401 |
| 4,273,029 | 6/1981 | Sheppard | 91/422 |
| 4,366,673 | 1/1983 | Lapp . | |
| 4,548,229 | 10/1985 | Johnson . | |
| 4,589,437 | 5/1986 | Zeuner et al. . | |
| 4,860,646 | 8/1989 | Spiers | 91/401 |
| 5,442,992 | 8/1995 | Sanner et al. . | |

*Primary Examiner*—F. Daniel Lopez
*Attorney, Agent, or Firm*—Trexler, Bushnell, Giangiorgi & Blackstone, Ltd.

[57] ABSTRACT

A novel adjustment assembly for use with a hydraulic control apparatus. The hydraulic control apparatus is attached to a hydraulically operated tool to provide a desired hydraulically powered function. The present invention allows the hydraulic control apparatus to be used with either a constant volume (open-center) hydraulic system or constant pressure (closed-center) hydraulic power system. The novel adjustment assembly of the present invention provides a structure which can be configured to force open shuttle spool valves in the control apparatus in a neutral condition for use with a constant volume power supply. The adjustment assembly can also be configured to be disengaged from the shuttle spool valves in a neutral condition for use with a constant pressure hydraulic power system. Operation of the adjustment assembly is made using standard tools and without disassembly of the control apparatus.

13 Claims, 5 Drawing Sheets

22
26
28
32
34
36
38
40
42
44
46
48
49
50
52
54
56
58
60
62
64
66
68
70
72
74
76
78
82
84
86
88
90
92
94
96
98
100
102
106
108
110
112

CONTROL VALVE HAVING A SENSOR SWITCHABLE BETWEEN AN OPEN AND A CLOSED CONDITION

BACKGROUND OF THE INVENTION

This invention is directed generally to a control system for operating a hydraulic tool. More particularly, the present invention is directed to an operating system employing a novel adjustment assembly used in a control system for a hydraulic tool which allows the tool to be used with either a constant pressure or a constant volume hydraulic fluid system without requiring disassembly or replacement of any parts in the tool.

Hydraulic tools generally operate using one of two basic types of hydraulic systems. The hydraulic systems which are used to operate such tools include the constant volume and constant pressure systems. In the constant volume system, the hydraulic fluid or oil must be free to flow back to the power source in an off or neutral position. The constant volume hydraulic systems use an on-off control valve arrangement which has an open-center spool to allow fluid to flow through the valve and back to the source when the valve is in its off or neutral position. As such, the terms "constant volume" and "open-center" are used interchangeably with respect to this type of system. In the open-center system, a positive displacement pump is used which continuously pumps hydraulic fluid through the system.

In the constant pressure system, the hydraulic pump operates only intermittently to achieve and maintain a desired pressure. The control valve associated with a constant pressure system employs a closed center spool to prevent fluid flow therethrough in the off or neutral position in order to maintain a desired system pressure. As such, the terms "constant pressure" and "closed-center" are used interchangeably. In the closed-center system, the system operates until a predetermined pressure is sensed whereupon the pump "destrokes" and the pressure compensated pump apparatus then operates to pump just enough to maintain the desired pressure. Various pumps or systems of this type are well known in the art.

Hydraulically driven tools are used in many applications in the field, for example, by utility companies for making crimp connections on power lines or by municipalities and park districts for operating pruning devices for tree management and maintaining landscaping. It should be understood, that while the present invention is shown as a crimping device which may be used to form crimp connection for use by a utility company, the present invention will find applications in a variety of hydraulically operated tools.

Many of the foregoing users of such tools frequently employ both constant pressure type and constant volume type hydraulic power sources. For example, various equipment such as central hydraulic power sources or trucks which are used in the field, may be equipped with one or the other type of hydraulic power source. Typically, it is undesirable or economically restrictive to maintain both types of power sources in each field location. Without being able to know which type of hydraulic power source will be used in any particular field application, many users of such hydraulic tool found it necessary or desirable to maintain duplicate sets of tools in order to operate with either type of system. However, providing duplicate sets of tools represents a substantial capitol investment as well as storage and maintenance costs even though it overcomes the problems associated with having only one type of hydraulic power system. Further, maintaining duplicate sets of tools requires additional space and additional training to make sure that the proper tool is used with the proper type of hydraulic system. Alternatively, one set of tools may be maintained in one type of hydraulic system selected for any given application. However, some devices such as trucks are provided with only one type of hydraulic system and therefore this may not be a feasible solution.

Another way of solving the problems associated with the two different types of hydraulic power sources is to design tools with interchangeable components, such as spool valves, one spool valve designed for open-center operation and the other spool valve designed for closed-center operations. The operator of the tool could then select and install the proper spool to match the hydraulic power source. However, this would require that duplicate spools be available for use with each tool, again requiring additional inventory and storage costs as well as space requirements. Moreover, providing interchangeable spool valves would require the operator to expend the time necessary to effect the change over and also have sufficient training and skills to properly disassemble and reassemble the valve portion of each tool.

Assuming that the problems associated with inventory and storage costs and space requirements and operator skill and training are overcome, the dual valve spools requires additional time at the job site for disassembly and reassembly of the valves. Another problem arises in that the frequent removal and replacement of the valve spools will also unnecessarily disturb the hydraulic system and seals and produce increased tool wear and the opportunity for the introduction of dirt and debris into the hydraulic system. Because these tools are intended for field applications, the introduction of such dirt and debris and disturbance of a hydraulic system is an important concern.

The prior art has proposed two solutions to the foregoing problems in the form of valve assemblies which were designed to work with either a normally closed or normally opened position. U.S. Pat. No. 3,882,883 discloses a valve assembly having a spool which may be rotated 180° to shift from a normally open operating mode to a normally closed operating mode. However, this valve design requires that a linkage rod be removed before the spool may be rotated. Thus, there is still the possibility of the linkage rod being improperly removed and improperly reassembled as well as possibly being lost, damaged during the removal or reassembly, or the introduction of contaminants into the system.

In U.S. Pat. No. 4,548,229, a valve assembly for accommodating both open-center and closed-center modes of operation is disclosed for use with an impact wrench. However, this valve assembly is suitable only for use with rotating tools, because the valve assembly itself is designed to shunt hydraulic fluid back to the source when the tool is in the off or neutral state, and the open-center mode of operation. This tool is provided with a specifically designed valve cylinder or sleeve which surrounds the valve spool. The sleeve is configured for open-center operation when in a first orientation and for closed center operation when it is rotated to a second orientation approximately 180° of rotation from its first orientation. This valve is designed to permit constant flow of hydraulic fluid through the tool when the valve is in its on position in both open-center and closed center modes of operation. The valve is designed to cut off the hydraulic fluid flow at the valve itself in the closed center mode of operation when the valve is in its closed or neutral position. Conversely, this valve is designed to direct flow through the valve itself and back to the source when in the off or neutral position in its open-center mode of operation.

In other words, in U.S. Pat. No. 4,548,229, both open-center and closed center modes, when the valve is in its off or neutral position, the valve does not permit flow of fluid past the valve and there is no fluid flow to the tool. However, such a valve arrangement will not work with a reciprocating type of hydraulic tool wherein it is necessary to alternately direct flow to opposite sides of a reciprocating piston. The crimping device disclosed in order to illustrate the present invention is one such type of tool which utilizes a reciprocating piston, rather than a rotating rotor as used in the tools such as the impact wrench of the above-mentioned U.S. Pat. No. 4,548,229.

A control system is shown in U.S. Pat. No. 5,442,992 issued Aug. 22, 1995 to Sanner et al. and assigned to the assignee of the present invention. The control system of Sanner '992 is designed for use with a hydraulically operated tool and allows the tool to be used with either an open-center system or a closed-center system. The Sanner '992 device has a rotatable selector which assists in configuring the control system for use with either the open-center or closed-center system.

OBJECTS AND SUMMARY

A general object satisfied by the claimed invention is to provide a novel hydraulic fluid flow control system for use with a hydraulic tool which allows the tool to be converted for use with a constant volume system to a constant pressure system and vice-versa, without the disassembly or removal of any parts from the tool.

Another object satisfied by the claimed invention is to provide a novel hydraulic fluid flow control system for use with a hydraulic tool which can be quickly and easily converted for operation with either a constant volume system or a constant pressure system as a power source using available common tools and skills.

Still another object satisfied by the claimed invention is to provide a novel hydraulic fluid flow control system based on a generally available and understood hydraulic tool thereby providing a hydraulic tool which can be used with either a constant volume system or a constant pressure system without requiring additional training or the maintenance of such a hydraulic tool.

Briefly, and in accordance with the foregoing, the present invention envisions a novel adjustment assembly for use with a hydraulic control apparatus. The hydraulic control apparatus is attached to a hydraulically operated tool to provide a desired hydraulically powered function. The present invention allows the hydraulic control apparatus to be used with either a constant volume (open-center) hydraulic system or constant pressure (closed-center) hydraulic power system. The novel adjustment assembly of the present invention provides a structure which can be configured to force open shuttle spool valves in the control apparatus in a neutral condition for use with a constant volume power supply. The adjustment assembly can also be configured to be disengaged from the shuttle spool valves in a neutral condition for use with a constant pressure hydraulic power system. Operation of the adjustment assembly is made using standard tools and without disassembly of the control apparatus.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DESCRIPTION

Figure 1:
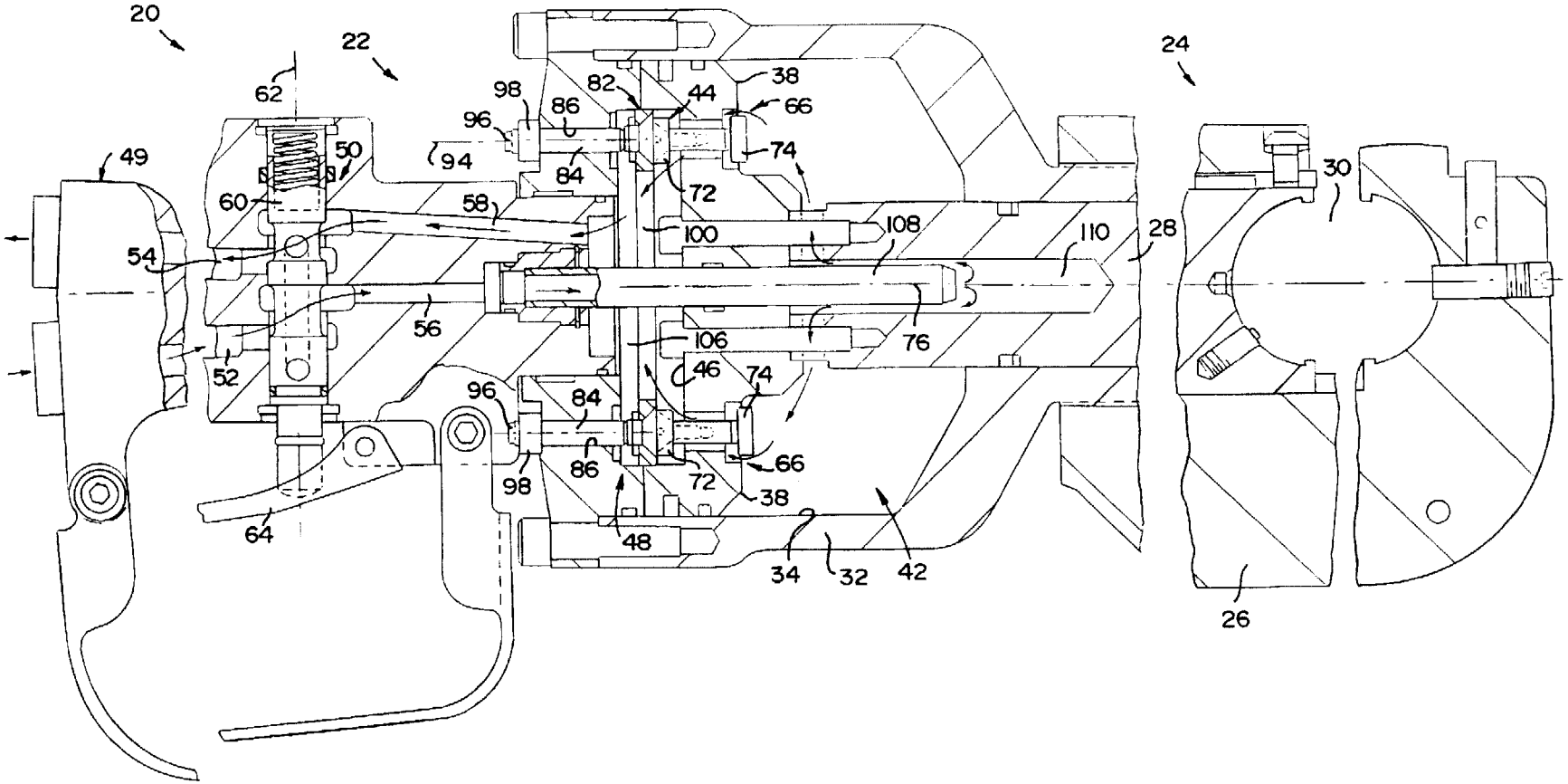
FIG. 1 is a partial fragmentary, cross-sectional, side elevational view of a hydraulic crimping tool in accordance with the claimed invention, configured for use with a constant volume or "closed-center" hydraulic power system in which a reciprocal piston and a crimping ram attached thereto are in a retracted position with the system in a neutral condition and in which an adjustment assembly is positioned to open shuttle spool valves associated with the piston.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

Figure 2:
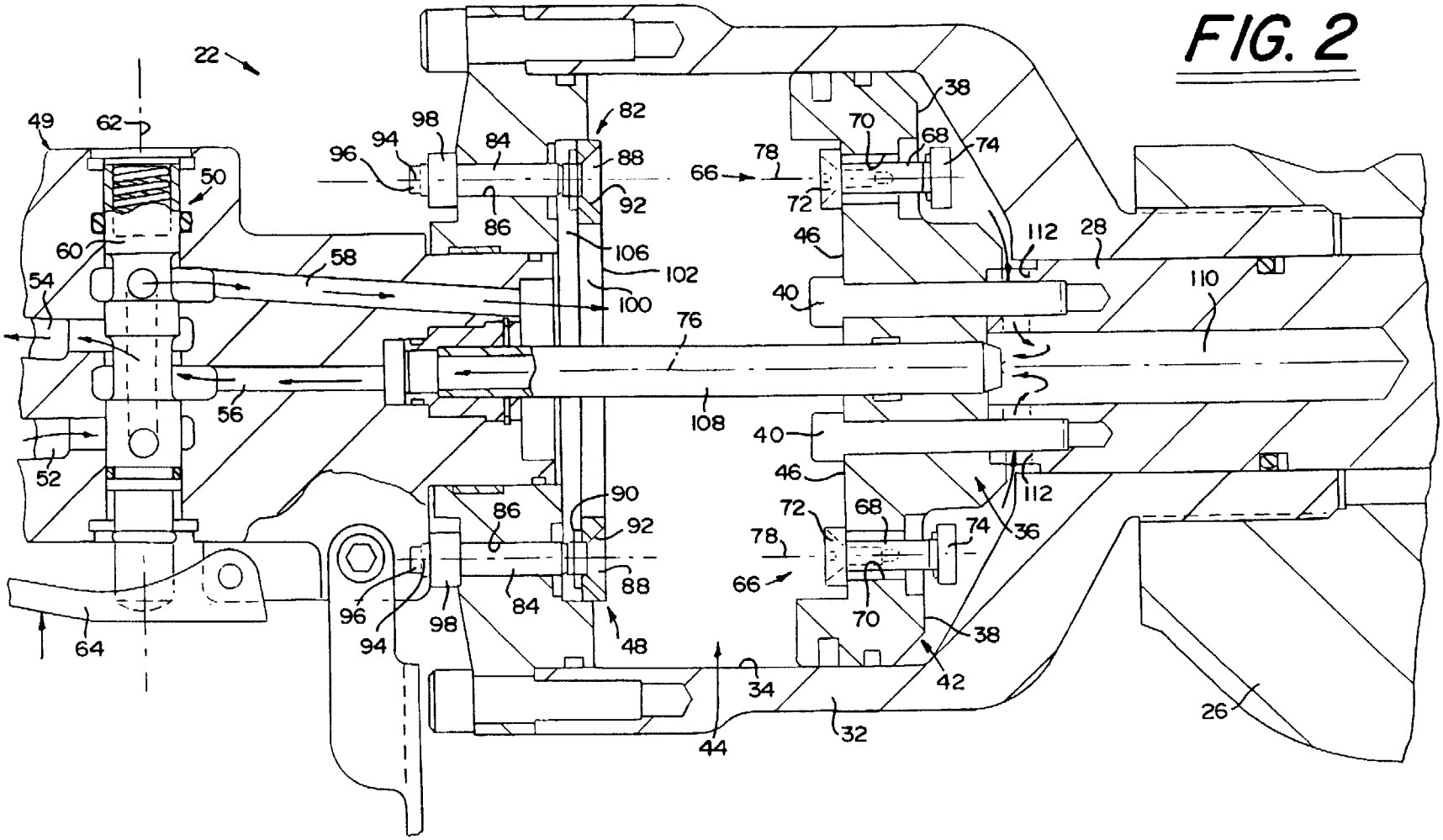
FIG. 2 is an enlarged, partial fragmentary, cross-sectional, side elevational view showing the control apparatus of the crimping tool as shown in FIG. 1 in the "on" condition in which the crimping ram is advanced by hydraulic forces acting on the reciprocal piston of the control apparatus.
Figure 3:
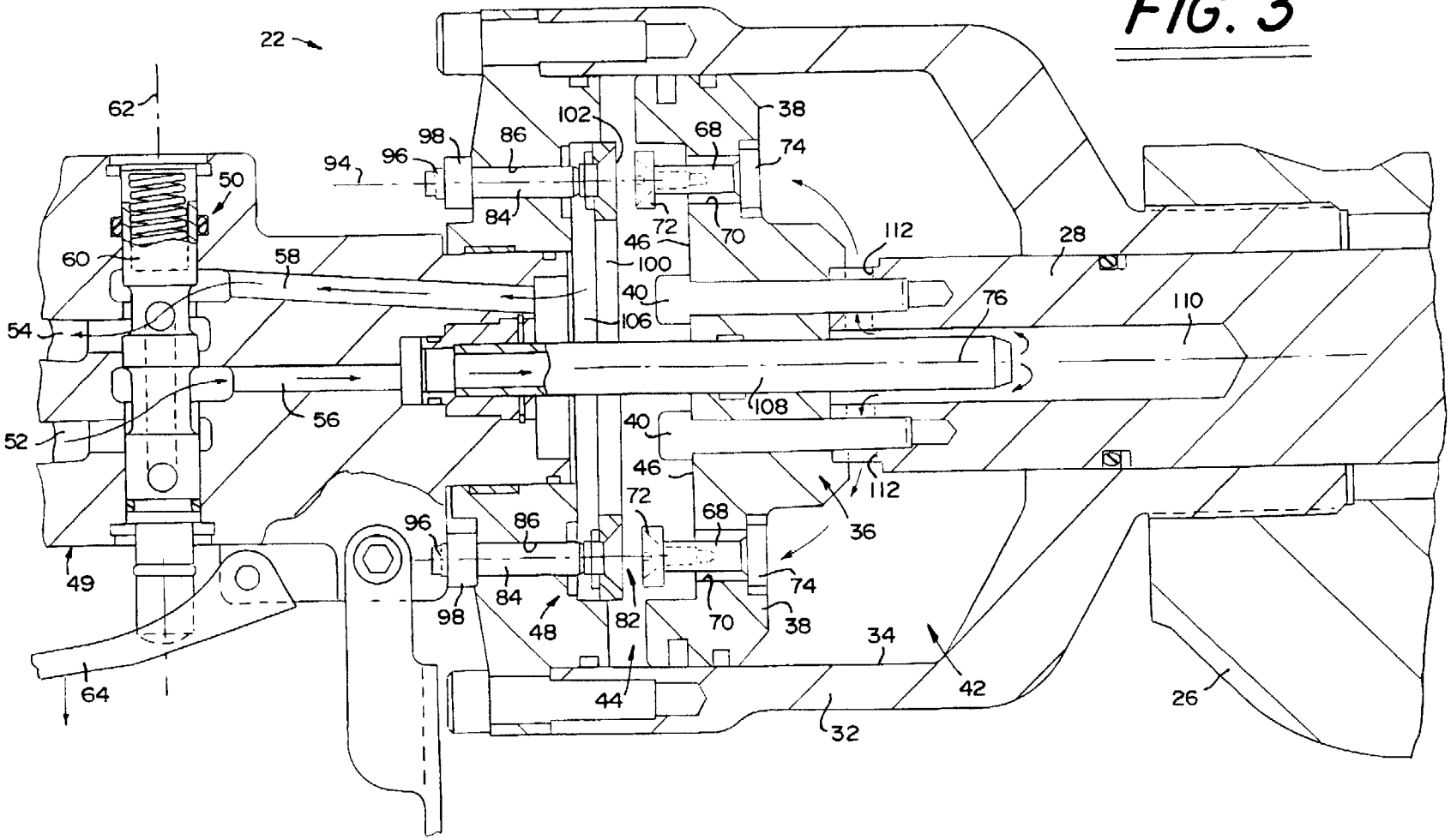
FIG. 3 is an enlarged, partial fragmentary, cross-sectional, side elevational view of the control apparatus as shown in FIGS. 1 and 2 in which the system is operated to retract the piston and the crimping ram attached thereto.
Figure 4:
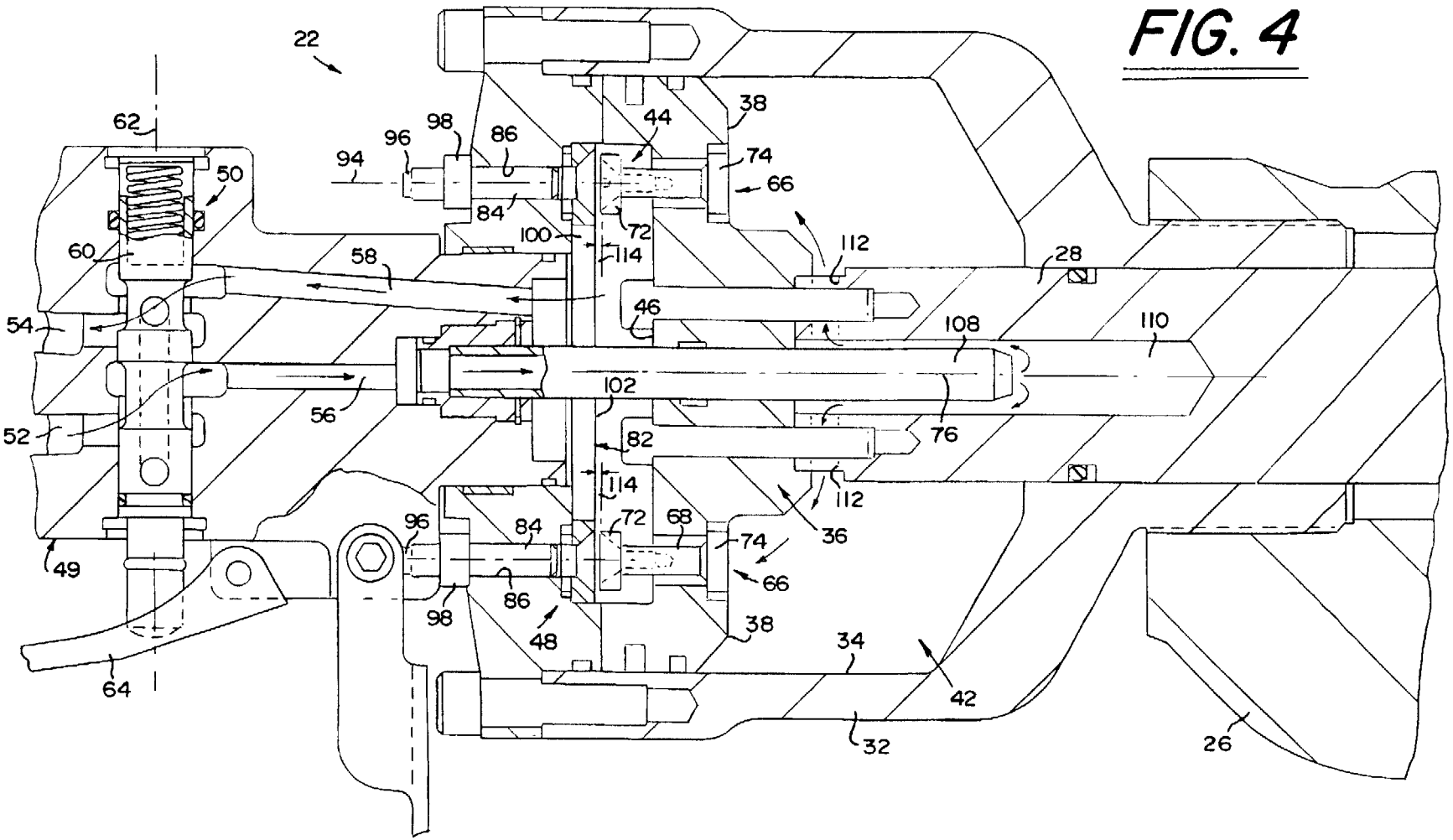
FIG. 4 is an enlarged, partial fragmentary, cross-sectional, side elevational view of the tool as shown in FIGS. 1–3 which has been configured for operation with a constant pressure or closed center hydraulic power system and in which the piston and crimping ram are in a retracted position and in which an adjustment assembly is positioned to prevent opening of shuttle spool valves associated with the piston.
Figure 5:
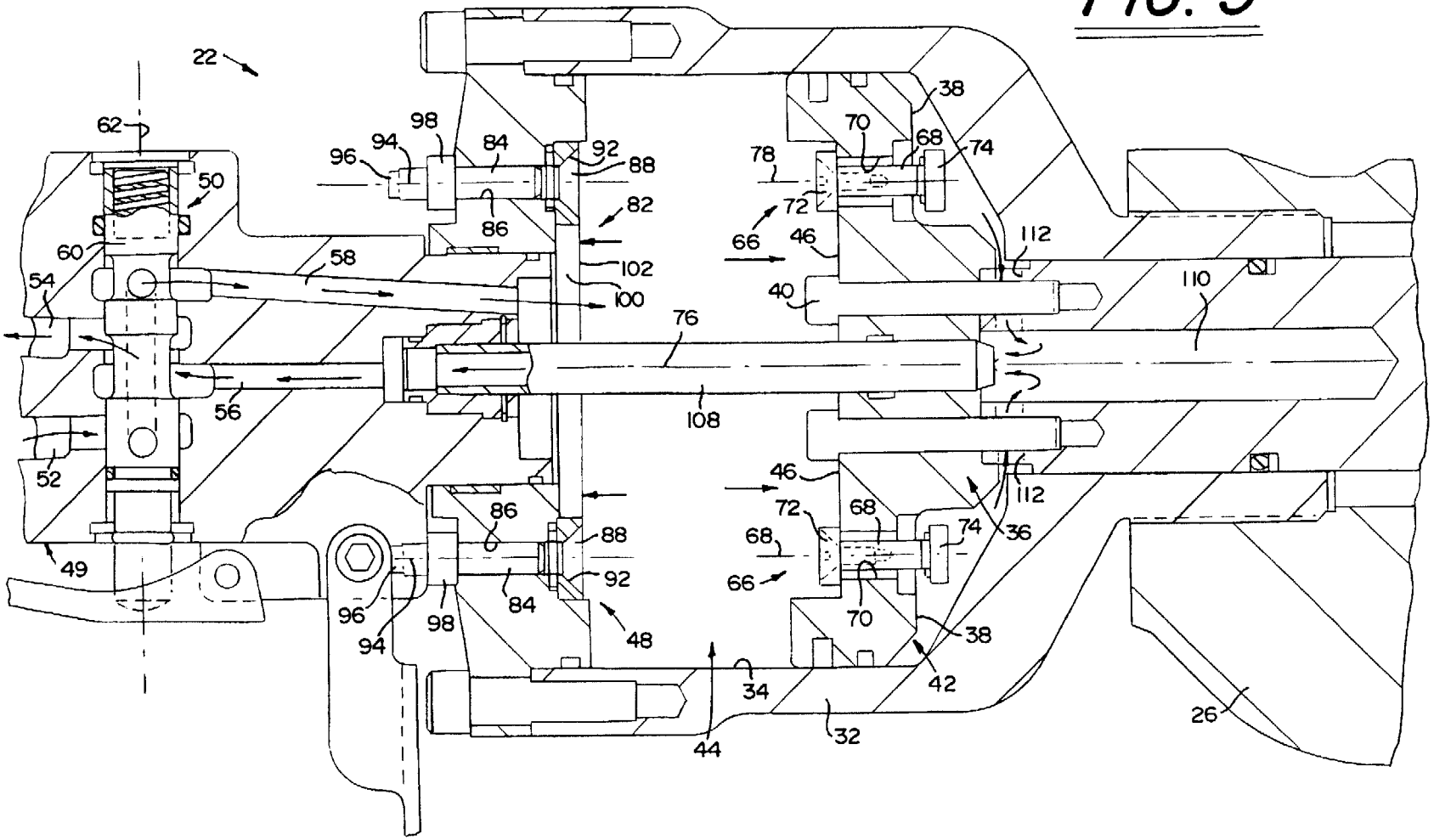
FIG. 5 is an enlarged, partial fragmentary, cross-sectional, side elevational view of the control portion of the hydraulic crimping tool as shown in FIG. 4 in which the piston is operated to advance the crimping ram.

As shown in FIG. 1, the present invention is described by way of a crimp connection hydraulic crimping tool 20 having a novel control apparatus 22 of the present invention which permits the same control apparatus 22 to be used with either a constant volume (open-center) or a constant pressure (closed-center) hydraulic power system. For reference, FIGS. 1–3 show the control apparatus 22 employed with a constant volume or open-center hydraulic power system whereas FIGS. 4 and 5 show the control apparatus 22 as used with a constant pressure or closed-center hydraulic power system. Further, FIG. 1 has been provided to show an entire tool whereas FIGS. 2–5 have been substantially enlarged to show the control apparatus 22 in greater detail.

The hydraulic crimping tool 20 includes a crimping ram unit 24 having a head portion 26 and a hydraulic crimping ram component 28. The crimping ram unit 24 is attached to the control apparatus 22 to provide reciprocal movement of the ram component 28 along the head 26. Movement of the ram component 28 relative to the head 26 provides crimping forces on a crimp connection (not shown) placed in a C-shaped aperture 30 defined therebetween. The control apparatus 22 regulates hydraulic forces to advance and retract the ram component 28 to provide a desired crimping effect on the crimp connection. It should be understood that the control apparatus 22 of the present invention may also be used with a variety of other hydraulic tools which require the ability to be used with either an open-center or a closed-center hydraulic power system. The present disclosure is illustrated by way of reference to the crimping-type tool as shown herein but is not limited to the crimping-type tool.

As shown in each of the FIGS. 1–5, the control apparatus 22 includes a housing 32 defining a cavity therein represented generally by reference numeral 34 with a reciprocal piston or driving piston 36 retained in the cavity 34 for movement towards and away from the head 26. The ram component 28 is attached to a first side 38 of the piston 36 by cap screws 40. A retract chamber 42 is defined between the first side 38 of the piston and the corresponding surfaces of the cavity 34 of the housing 32. A drive chamber 44 is similarly defined between a second side 46 of the piston 36 and corresponding surfaces of the cavity 34 of the housing 32. A novel adjustment assembly 48, as described in greater detail below, is retained in the drive chamber 44 to control fluid flow between the retract chamber 42 and drive chamber 44 in a neutral mode.

The control apparatus 22 also includes a handle structure 49 containing a valve assembly 50. An inlet port 52 and an outlet 54 extend through the handle structure 49 for connection to a hydraulic power system (not shown) of a known construction. The inlet port 52 and outlet port 54 can be connected to either the constant volume or constant pressure system. A central port 56 selectively connects the inlet port 52 with the retract chamber 42 as will be described in greater detail hereinbelow. A cross port 58 communicates with the drive chamber and selectively with the outlet port 54.

The valve assembly 50 includes a spindle valve 60 which is axially displaceable along a spindle axis 62. Operation of such a spindle valve is well known in the art as shown in U.S. Pat. No. 5,442,992 issued Aug. 22, 1995 to Sanner et al. and assigned to the assignee of the invention disclosed and claimed herein. Briefly, a trigger 64 is gripped by an operator to displace the spindle valve 60 to selectively configure the inlet port 52, outlet port 54, central port 56 and cross port 58 in order to extend or retract the piston 36. Further description of the operation of the valve assembly and the movement of the piston 36 will be provided in greater detail hereinbelow. Additionally, U.S. Pat. No. 5,442,992 is incorporated herein by reference.

At least one, as illustrated, a plurality of shuttle spool valves 66 are carried on the piston 36. Each shuttle spool valve 66 includes a shuttle spool 68 which is retained in a shuttle port 70 formed in the piston. The shuttle port 70 extends from the first side 38 through the piston to the second side 46. Enlarged heads 72, 74 are provided on each end of the shuttle spool 68. Each spool valve 66 is generally radially positioned on the piston 36 at a generally equal radial distance from a central axis 76 of the control apparatus 22. Further, each spool valve 66 operates along a valve axis 78 which is generally parallel to the central 76.

The adjustment assembly 48 of the present invention is provided to allow the control apparatus 22 to be configured for either a constant volume or a constant pressure hydraulic power source. When the adjustment assembly 48 is configured for use with a constant volume system the shuttle spool valves 66 are moved as a result of contacting the adjustment assembly 48 when the piston 36 is retracted. Movement of the spool valves 66 unseats valve heads 74 from the shuttle port 70. By disengaging the heads 74 fluid flows from the retract chamber 42 to the drive chamber 44 when the piston is in a neutral position as shown in FIG. 1. As shown in FIG. 4, the adjustment assembly 48 may be configured to be spaced away from the shuttle spool valves 66 for use with a constant pressure system thereby preventing engagement with the shuttle spool valve 66 causing the spool valve heads 74 to seal the shuttle port 70 when the piston is in a neutral position.

The adjustment assembly 48 as shown in FIGS. 1–5 includes a control body or annular member 82 which is attached to adjustment shafts 84 extending through a shaft bore 86 in the housing 32. The control body 82 is assembled with the adjustment shafts 84 by way of a conical head 88 on each adjustment shaft 84 and a retaining ring 90, see FIG. 2. The conical head 88 engages a corresponding conical aperture 92 in the control body 82. The retaining ring engages the adjustment shaft on an opposite side of the control body 82. Both the adjustment shaft 84 and the shaft bore 86 are threaded allowing incremental adjustment of each adjustment shaft 84 along an adjustment axis 94 while also sealing the shaft bore 86 against fluid flow from the drive chamber 44. A drive head 96 is provided on a portion of the adjustment shaft 84 which projects from the housing 32 and a locking seal nut 98 is positioned between the drive head 96 and the housing 32 to lock a desired adjustment of adjustment shaft 84 and seal the bore 86 against possible leakage from the drive chamber.

As shown in FIGS. 1–5, the control body 82 is provided in the form of an annular body which defines a central opening 100. The annular shape of the control body 82 is important to the operation of the illustrated embodiment of the present invention. The annular shape of the control body 82 provides a contact surface 102 along a radially spaced area. As such, no matter where the shuttle spool valves 66 are positioned, the drive chamber side head 72 is always positioned for engagement with the contact surface 102. While it is envisioned that individual adjustment shafts 84 may be provided in coaxial alignment with the shuttle spool valves 66, the annular control body 82 does not depend upon the specific location of a shuttle spool valve 66 other than the radial dimension relative to the central axis 76.

An additional benefit of the annular control body 82 is that a minimal number of adjustment shafts 84, for example 3 or 4, may be used to evenly and reliably position the control body 82 to contact a multiplicity of shuttle spool valves 66. For example, 6 or 8 shuttle spool valves may be actuated by the control body 82. Adjustment of the control body 82 requires adjusting only three or four adjustment shafts to achieve such results. As such, the present invention provides an easy, reliable and efficient means for configuring a hydraulic control apparatus 22 for use with either a constant volume or a constant pressure system.

As shown, the control body 82 is positioned in the drive chamber 44. A recess 106 is provided in the housing to receive the control body 82 when it is positioned away from the piston 36 in order to provide a configuration for a constant pressure system (see FIGS. 4 and 5). In the constant pressure system configuration as shown in FIGS. 4 and 5, fluid does not flow through the shuttle port 70 because the heads 74 of the valves 66 are seated to seal the corresponding shuttle ports 70. As the retract chamber 42 is pressurized, the piston is retracted (moved to the left-hand side of the drawings). As the piston 36 is retracted, hydraulic fluid in the drive chamber 44 is vented through the central opening 100 and into the cross port 58. In a similar manner, in both the constant volume and constant pressure configurations, a central tube 108 communicating with the central port 56 and the retract chamber 42 extends through the central opening 100 and the piston 36. In this manner, the control body 82 does not interfere with the configuration for either the constant volume or the constant pressure systems.

We now turn to a step-by-step review of the operation of the present invention by further reference to FIGS. 1–5. With reference to FIG. 1, the adjustment assembly 48 is positioned for use with an open-center or constant volume system hydraulic power system. The piston 36 is shown in the fully retracted position in which the spool valves 66 are opened by contact of the head 72 against the control body 82. This is the neutral position of a constant volume system which allows fluid to continuously flow from the inlet port 52 through the control apparatus 22 and back through the outlet port 54.

More specifically, the spindle valve 60 is positioned to allow fluid to flow from the inlet port 52 to the central port 56, through the central tube 108 into a central chamber 110 in the ram component 28. Fluid is vented from the central chamber 110 through radial ports 112 formed therethrough which communicate with the retract chamber 42. Because the shuttle spool valves 66 are opened, fluid flows from the retract chamber 42 into the drive chamber 44. Fluid flows from the drive chamber 44 through the central opening 100 of the control body 82 and into the cross port 58, through the valve assembly 50 and through the outlet port 54 which is placed in communication with the cross port 58 as a result of the position of the spindle valve 60.

Turning to FIG. 2, the trigger 64 has been operated to axially displace the spindle valve 60 along the spindle axis 62 thereby placing the inlet port 52 in communication with the cross port 58. In this condition, fluid flows into the drive chamber 44 shifting the shuttle spool valve 66 to position the heads 72 against the second side 46 of the piston thereby sealing the shuttle port 70. Once the shuttle port 70 is sealed, increased pressure in the drive chamber 44 causes the piston 36 to advance through the cavity 34. Advancement of the piston 36 through the cavity 34 forces fluid from the retract chamber 42 through the radial ports 112 and into the central chamber 110. Fluid flows from the central chamber 110 through the central tube 108 into the central port 56 which is in communication with the outlet port 54 as a result of the axial displacement of the spindle valve 60.

FIG. 3 shows the constant volume configuration in which the trigger 64 has been released, thereby actuating the spindle valve 60 to cause the piston 36 to be retracted. Once the spindle valve 60 is axially shifted, the inlet port 52 is placed in communication with the central port 56 thereby providing fluid to pressurize the retract chamber 42. When the retract chamber becomes pressurized, the shuttle spool valves 66 are shifted to cause the heads 74 to seat against the first side 38 of the piston to seal the shuttle port 70. Because fluid cannot flow through the shuttle ports, increased pressure in retract chamber 42 forces the piston to be retracted. The shifting of the spindle valve 60 also places the cross port 58 in communication with the outlet port 54 thereby allowing fluid to be vented from the drive chamber 44 through the cross port 58.

As the piston approaches the control body 82, the shuttle spool valves 66 are operated against the contact surfaces 102 of the control body 82 to move from the position as shown in FIG. 3 to the position as shown in FIG. 1. Clearly, the shifting of the spool valves 66 results in the heads 74 being unseated from the first side 38 of the piston 36 and allowing fluid to flow through the now opened shuttle ports 70. In this condition, the pressure in the retract chamber 42 and the drive chamber 44 is generally equalized and fluid may flow continuously through the control apparatus 22.

Turning now to the constant pressure system as shown in FIGS. 4 and 5, the identical structure is used as shown in FIGS. 1–3, except for the adjustment which is made to the adjustment assembly 48. In FIGS. 4 and 5, the adjustment shafts 84 are driven to withdraw the control body 82 into the recess 106. Once the control body 82 is fully retracted into the recess 106, the locking seal nuts 98 are tightened to retain this position. In the fully recessed position, a slight, yet sufficient gap 114 is provided between the heads 72 and the contact surface 102 of the control body 82.

In this condition, the neutral position is maintained by constant pressure in the retract chamber 42. In the neutral position, the spindle valve 60 is a position in which the inlet port 52 communicates with the central port 56 thereby delivering fluid to the retract chamber 42 with no opening through which to be vented. No openings are provided because the heads 74 of the shuttle spool valves 66 are seated against the first side of the piston 36 thereby sealing the shuttle ports 70. Pressure feedback is sensed by the constant pressure power source through the line connected to the inlet port 52. The constant pressure hydraulic power source will then provide a stationing function to retain a generally constant pressure.

When the trigger 64 is operated, the spindle valve 60 is shifted thereby placing the inlet port 52 in communication with the cross port 58 to pressurize the drive chamber 44 and drive the piston 36. The operation of this pressurizing sequence to drive the piston 36 and the ram 28 attached thereto is the same as described hereinabove with regard to the FIG. 2. For example, fluid is vented from the retract chamber 42 through the central port 56 into the outlet port 54.

While a preferred embodiment of the present invention is shown and described, it is envisioned that those skilled in the art may devise various modifications and equivalents without departing from the spirit and scope of the appended claims. The invention is not intended to be limited by the foregoing disclosure.

The invention claimed is:

1. A hydraulic control apparatus which is selectively configurable for use, independently, with a constant volume hydraulic power system and a constant pressure hydraulic power system, said hydraulic control apparatus comprising: a hollow housing defining a cavity therein; a reciprocal piston retained in said cavity of said hollow housing, said piston having a first side and a second side; a retract chamber defined between a portion of said hollow housing and said first side of said piston; a drive chamber defined between a portion of said housing and said second side of said piston; a controllable valve assembly coupled to said housing having an inlet port, an outlet port, a central port, and a cross port, said cross port communicating with said drive chamber, and said central port communicating with said retract chamber; at least one shuttle valve carried on said piston being selectively operable to control fluid flow between said retract chamber and said drive chamber through said piston; and an adjustment assembly coupled to said control apparatus for controlling the operation of said at least one shuttle valve, said adjustment assembly being positioned proximate to said piston when said piston is retracted for contacting and unseating said at least one shuttle valve from said piston for use with a constant volume hydraulic power system and said adjustment assembly being positioned away from said piston for preventing contact with said at least one shuttle valve for use with a constant pressure hydraulic power system.

2. A hydraulic control apparatus as recited in claim 1, said adjustment assembly further comprising an adjustable shaft extending through said housing having an end positioned for contacting a corresponding one of said at least one shuttle valves, said adjustable shaft having a drive portion for advancing and retracting said end of said adjustable shaft relative to said corresponding one of said at least one shuttle valves.

3. A hydraulic control apparatus as recited in claim 2, wherein said adjustable shaft is a threaded shaft threadedly engaged with said housing, said drive portion being positioned externally of said housing and including a drive head and a lock nut thereon for retaining a desired adjustment of said adjustable shaft relative to a corresponding one of said at least one shuttle valves.

4. A hydraulic control apparatus as recited in claim 3, said adjustment assembly further comprising: said adjustable shaft being positioned on an adjustment axis radially spaced from and generally parallel to a central axis of said control apparatus, said adjustment axis being substantially coaxial with a valve axis defined by said at least one shuttle valves, coaxial alignment of said adjustment axis and said valve axis providing direct transference of forces from each of said at least one shuttle valves to said adjustable shaft.

5. A hydraulic control apparatus as recited in claim 1, said adjustment assembly further comprising: a control body retained in said drive chamber proximate to said second side of said piston; and a least one adjustment shaft connected to said control body for adjustably positioning said control body relative to said at least one shuttle valves, whereby when said control apparatus is connected with a constant volume system positioning said control body towards said piston contacts said at least one shuttle valve when said piston is retracted to disengage said at least one shuttle valve and permit fluid flow through said piston, and when said control apparatus is connected to a constant pressure system positioning of said control body away from said piston prevents contact with said at least one shuttle valve when said piston is retracted to prohibit disengagement of said at least one shuttle valve and prevent fluid flow through said piston.

6. A hydraulic control apparatus as recited in claim 5, said adjustment assembly further comprising: a recess in said housing proximate to said control body for receiving said control body therein when said control body is positioned away from said piston for use in a constant pressure system, said recess being sized and dimensioned to provide at least a nominal space between said control body and said at least one shuttle valve for preventing engagement of said control body and said shuttle valve.

7. A hydraulic control apparatus which is selectively configurable for use, independently, with a constant volume hydraulic power system and a constant pressure hydraulic power system, said hydraulic control apparatus comprising: a hollow housing defining a cavity therein: a reciprocal piston retained in said cavity of said hollow housing, said piston having a first side and a second side; a retract chamber defined between a portion of said hollow housing and said first side of said piston; a drive chamber defined between a portion of said housing and said second side of said piston; a controllable valve assembly coupled to said housing having an inlet port, an outlet port, a central port being generally axially positioned in said control apparatus extending through said piston and communicating with said retract chamber, and a cross port, said cross port being radially spaced from said central port and communicating with said drive chamber, and at least one shuttle valve carried said piston being selectively operable to control fluid flow between said retract chamber and said drive chamber through said piston; and an adjustment assembly coupled to said control apparatus for controlling the operation of said at least one shuttle valve said adjustment assembly having an annular control body positioned in said drive chamber, said annular control body defining a central opening being sized and dimensioned for defining a radial space around said cross port and said central port; a plurality of adjustment shafts attached to said annular control body at spaced apart locations and extending through said housing for positioning said annular control body relative to said piston; and said at least one shuttle valve being located on said piston proximate to said annular control body when said piston is retracted towards said annular control body; said adjustment assembly being positioned proximate to said piston when said piston is retracted for contacting and unseating said at least one shuttle valve from said piston for use with a constant volume hydraulic power system and said adjustment assembly being positioned away from said piston for preventing contact with said at least one shuttle valve for use with a constant pressure hydraulic power system, and whereby said plurality of said adjustment shafts being operated to position said annular control body toward said piston for contact with said at least one shuttle valve to unseat said at least one shuttle valve from said piston for use with a constant volume hydraulic power system and said plurality of said adjustment shafts being operated to withdraw said annular control body from said piston for preventing contact with said at least one shuttle valve for use with a constant pressure system.

8. A hydraulic control apparatus which is selectively configurable for use, independently, with a constant volume hydraulic power system and a constant pressure hydraulic power system, said hydraulic control apparatus comprising: a hollow housing defining a cavity therein; a two-sided, reciprocal piston retained in said cavity; a retract chamber defined between said hollow housing and a first side of said piston, said retract chamber being pressurized for retracting said piston in said cavity; a drive chamber defined between said housing and a second side of said piston, said drive chamber being pressurized for driving said piston in said cavity; at least one shuttle valve carried on said piston being selectively operable to control fluid flow between said retract chamber and said drive chamber through said piston; and an adjustment coupled to said control apparatus for controlling the operation of said at least one shuttle valve, said adjustment assembly being positioned toward said piston for contact with said at least one shuttle valve to unseat said at least one shuttle valve from said piston for use with a constant volume hydraulic power system and said adjustment assembly being withdrawn from said piston for preventing contact with said at least one shuttle valve for use with a constant pressure system.

9. An adjustment assembly for use with a hydraulic control apparatus of a hydraulic tool which allows the hydraulic tool to be attached to, independently, a constant volume hydraulic power system and a constant pressure hydraulic power system, said hydraulic control apparatus including a hollow housing defining a cavity and retaining a two-sided, reciprocal piston therein, a retract chamber defined between said hollow housing and a first side of said piston, a drive chamber defined between said housing and a second side of said piston, at least one shuttle valve carried on said piston being selectively operable to control fluid flow between said retract chamber and said drive chamber through said piston, said adjustment assembly comprising: a control body positioned in said drive chamber proximate to said at least one shuttle valve; a least one adjustment shaft connected to said control body for adjustably positioning said control body relative to said at least one shuttle valves; whereby when said control apparatus is connected with a constant volume system said adjustment shaft is operated to position said control body towards said piston for contacting said at least one shuttle valve when said piston is retracted to disengage said at least one shuttle valve and permit fluid flow through said piston, and when said control apparatus is connected to a constant pressure system said adjustment shaft is operated to position said control body away from said piston for preventing contact with said at least one shuttle valve when said piston is retracted to prohibit disengagement of said at least one shuttle valve and prevent fluid flow through said piston.

10. An adjustment assembly for use with a hydraulic control apparatus of a hydraulic tool which allows the hydraulic tool to be attached to, independently, a constant volume hydraulic power system and a constant pressure hydraulic power system said hydraulic control apparatus including a hollow housing defining a cavity and retaining a two-sided, reciprocal piston therein, a retract chamber defined between said hollow housing and a first side of said piston, a drive chamber defined between said housing and a second side of said piston, at least one shuttle valve carried on said piston being selectively operable to control fluid flow between said retract chamber and said drive chamber through said piston, said adjustment assembly comprising: a control body positioned in said drive chamber proximate to said at least one shuttle valve: a least one adjustment shaft connected to said control body for adjustably positioning said control body relative to said at least one shuttle valves, said adjustment assembly further comprising: said control body having an annular shape and being positioned in said drive chamber and being sized and dimensioned for being radially spaced away from said cross port and said central port: a plurality of said adjustment shafts attached to said annular control body and extending through oh said housing for advancing and withdrawing said annular control body relative to said piston. said shuttle valves being located on said piston in a position proximate to said annular control body: a controllable valve assembly coupled to said housing having an inlet port, an outlet port, a generally axially positioned central port, and a cross port radially spaced from said central port, said cross port communicating with said drive chamber, and said central port communicating with said retract chamber: whereby when said control apparatus is connected with a constant volume system said adjustment shaft is operated to position said control body towards said piston for contacting said at least one shuttle valve when said piston is retracted to disengage said at least one shuttle valve and permit fluid flow through said piston, and when said control apparatus is connected to a constant pressure system said adjustment shaft is operated to position said control body away from said piston for preventing contact with said at least one shuttle valve when said piston is retracted to prohibit disengagement of said at least one shuttle valve and prevent fluid flow through said piston.

11. An adjustment assembly for use with a hydraulic control apparatus of a hydraulic tool as recited in claim 10, wherein each of said adjustment shafts is a threaded shaft threadedly engaged with said housing, a drive portion of each of said adjustment shafts being positioned externally of said housing and including a drive head and a lock nut thereon for retaining a desired adjustment of said adjustable shaft relative to a corresponding one of said at least one shuttle valves.

12. A hydraulic control apparatus which is selectively configurable for use, independently, with a constant volume hydraulic power system and a constant pressure hydraulic power system, said hydraulic control apparatus comprising: a housing defining a cavity therein, said housing having a bore for receiving a hydraulic ram component of said hydraulic tool; a piston positioned in said cavity of said housing, a first side of said piston being attached to said hydraulic ram component for driving and retracting said hydraulic ram component upon activation of said control apparatus, said first side of said piston and said housing defining a retract chamber and a second side of said piston and said housing defining a drive chamber; a valve assembly coupled to said housing selectively communicating with an inlet port, an outlet port, a central port, and a cross port, said cross port communicating with said drive chamber and said central port communicating with said retract chamber; a plurality of shuttle valves carried on said piston for controllably opening and closing a shuttle port in said piston; an annular control body positioned in said drive chamber; adjustment shafts attached to said annular control body and threadedly extending through said housing for adjustably positioning said control body relative to said piston; whereby when said control apparatus is used with a constant volume hydraulic power system said annular control body is positioned toward said piston to contact said shuttle valves when said piston is retracted to unseat said shuttle valves from said piston for permitting fluid flow from the retract chamber through the shuttle ports to the drive chamber, and when said control apparatus is used with a constant volume hydraulic power system said annular control body is positioned away from said piston to prevent contact with said shuttle valves when said piston is retracted.

13. A method of selectively configuring a hydraulic control apparatus for use, independently, with a constant volume hydraulic power system and a constant pressure hydraulic power system, said control apparatus having a housing with a reciprocal piston retained therein, at least one shuttle valve carried on said piston being selectively operable to control fluid flow between chambers of said control apparatus through said piston, said method comprising the steps of:

providing an adjustment assembly coupled to said control apparatus proximate to a drive side of said piston;

positioning said adjustment assembly towards said piston for contacting and unseating said at least one shuttle valve from said piston when said piston is retracted for use with a constant volume hydraulic power system and positioning said adjustment assembly away from said piston for preventing contact with said at least one shuttle valve for use with a constant pressure hydraulic power system.

* * * * *

UNITED STATES PATENT AND TRADEMARK OFFICE

CERTIFICATE OF CORRECTION

PATENT NO. : 5,778,755

DATED : July 14, 1998

INVENTOR(S) : Thomas Gene Boese

It is certified that error appears in the above-indentified patent and that said Letters Patent is hereby corrected as shown below:

Title Page:

[57] ABSTRACT

Page 1 Lines 10,11 and 13 "shuttle spool valves" should be

-- shuttle valves --

Column 3 Lines 54 and 57 "shuttle spool valves" should be

-- shuttle valves --

Column 4, Lines 10 and 26 "shuttle spool valves" should be

-- shuttle valves --

Column 5, Lines 43 and 44 "shuttle spool valves" should be

-- shuttle valves --

Column 5, Line 49 "72,74" should be -- 74 --

UNITED STATES PATENT AND TRADEMARK OFFICE

CERTIFICATE OF CORRECTION

PATENT NO. : 5,778,755

DATED : July 14, 1998

INVENTOR(S) : Thomas Gene Boese

It is certified that error appears in the above-indentified patent and that said Letters Patent is hereby corrected as shown below:

Column 5 Lines 59-60 "shuttle spool valves 66" should be -- shuttle spools 68 --

Column 5, Line 62 " spool valves 66" should be -- shuttle spools 68 --

Column 5, Line 67 "shuttle spool valves" should be -- shuttle valves --

Column 6, Line 2 "shuttle spool valves 66" should be -- shuttle spools 68 --

Column 6, Line 30 "shuttle spool valves" shoule be -- shuttle valves --

Column 7, Line 18 "shuttle spool valves" should be -- shuttle valves --

Column 7, Lines 29, 46-47, 55-56 "shuttle spool valves 66" should be -- shuttle spools 68 --

UNITED STATES PATENT AND TRADEMARK OFFICE

CERTIFICATE OF CORRECTION

PATENT NO. : 5,778,755

DATED : July 14, 1998

INVENTOR(S) : Thomas Gene Boese

It is certified that error appears in the above-indentified patent and that said Letters Patent is hereby corrected as shown below:

Column 8, Line 15 "shuttle spool valves 66" should be
-- shuttle spools 68 --

Column 9, Lines 64-65 "valve carried" should be -- valve carried on --

Column 11, Line 36 "through oh" should be -- through said --

Signed and Sealed this

Fourth Day of May, 1999

*Attest:*

*Attesting Officer*

Q. TODD DICKINSON

*Acting Commissioner of Patents and Trademarks*